United States Patent [19]

Courtin

[11] 4,323,153

[45] Apr. 6, 1982

[54] DISPLAY CASE FOR A LUXURY ARTICLE

[76] Inventor: Gerard C. L. Courtin, 43, Avenue George V, 75008 Paris, France

[21] Appl. No.: 61,889

[22] Filed: Jul. 30, 1979

[30] Foreign Application Priority Data

Jul. 31, 1978 [FR] France ..... 78 22643

[51] Int. Cl.[3] ..... B65D 5/50; B65D 85/00; A47B 88/04

[52] U.S. Cl. ..... 206/45.13; 206/45.15; 312/13; 312/25

[58] Field of Search ..... 206/45.13, 45.15, 45.14, 206/8, 45.19; 312/13, 25, 24

[56] References Cited

U.S. PATENT DOCUMENTS

| | | | |
|---|---|---|---|
| 1,247,057 | 11/1917 | Yerger | 312/25 |
| 1,849,248 | 3/1932 | Quinn | 206/45.15 |
| 2,608,456 | 8/1952 | Barth | 312/24 |
| 2,916,140 | 12/1959 | McKay | 206/45.13 |
| 3,140,700 | 7/1964 | Gordan | 206/45.13 |
| 3,140,777 | 7/1964 | Gordon | 206/45.13 |
| 3,265,453 | 8/1966 | Seide | 312/13 |
| 3,836,222 | 9/1974 | Kuntze | 206/45.13 |
| 3,987,894 | 10/1976 | Bidegain | 206/45.15 |

*Primary Examiner*—William T. Dixson, Jr.
*Attorney, Agent, or Firm*—Keil & Witherspoon

[57] ABSTRACT

A hollow, display case having a rectilinear shape and split diagonally into two, separable prismatic sections, one immovable prismatic section being hingedly connected to the other mobile section at the edge of the base of the former and pivotable 180° from a closed position to a display position so that the two sections form facing, hollow prisms, a support for a luxury article housed in the case initially positioned at an angle relative to the base of one hollow, prismatic section when the case is closed and connected to the respective sections so that, upon opening the case and moving the mobile section to the display position, the support and the article thereon pivot and move to a position with the support parallel with the base and in the approximate center of the V formed by the facing, hollow prisms.

9 Claims, 5 Drawing Figures

20
14
13

21
10
8
1
11
22
17
16
19
12
15
2

9
10
8
11
2
9
1
15
12

DISPLAY CASE FOR A LUXURY ARTICLE

SUMMARY OF TECHNICAL CONTENT OF INVENTION

The invention relates to a display case, particularly for a luxury article.

This case comprises: two parts solid with one another, one 1 called immobile comprising a plane base acting as a support for the case and the other 2 being mobile relative to the first; a support 8 for displaying article 7 mounted inside the case being articulated on said first mobile part and able, during movement of this mobile part, to slide in the first part, approximately in horizontal translation, so as to remove the support from the first part of the case and to expose it to view.

Applicable to the display of a bottle of perfume, a jewel, a lighter.

This invention relates to a case, particularly for a luxury article such as a perfume bottle, jewel, lighter, for example, said case also constituting a display unit for the article.

The purpose of the invention is to achieve a case that can take two positions: one, the "closed" position, for which the article placed on the inside is invisible and the other, the "open" position, for which the article is exposed and displayed without, however, being removed from its packaging.

For this purpose, the invention has for its object a display case, particularly for a luxury article, wherein it comprises: two parts solid with one another, one called "immobile" comprising a plane base acting as a support for the base and the other being mobile with relation to the first; a support for displaying the article mounted on the inside of the case and being articulated on said mobile part and able, during movement of this mobile part, to slide in the first part, approximately in horizontal translation, so as to remove said support from the first part of the case and expose it to view between the two parts of the case.

This display case can then occupy two stable positions: one for which the article is invisible, the case being completely closed, and the other for which the article is exposed between the two parts of the case, opened by simple drawing or pivoting without touching the article which remains on its inside display support and moves with the latter.

According to a preferred embodiment, the display case is parallelepipedic and opens along a diagonal plane, said mobile part being articulated on the first part, called "immobile," around a horizontal axis located at the lower end of the diagonal plane.

This display case, in its open position, delimits two symmetrical parts in a V-shaped space in the middle of which is exposed to view, on its display support, the article which is then placed approximately in the plane of symmetry of the display case thus opened out.

According to other preferred embodiments, the case display support is articulated on the mobile part around two pins that define an axis of rotation parallel to the axis serving for articulation of the two parts constituting the case; the display support is provided with guide means working with complementary organs solid with the first part of the display case to assure the movement of the support in an approximately horizontal translation; said guide means are made up of at least a groove shaped laterally to the display support and working with at least a pin fastened on the inside face of the first part of the case; the width of the display support is equal to the distance separating the opposite faces of the case so that the sliding is done with slight friction; the display support comprises a plane upper face in which is made a housing for receiving the article to be displayed; each of the two parts constituting the case is provided on the inside with a setting element for the article to wedge the latter in the space where the case is completely closed.

For a better understanding of the object of this invention, there will be described below, by way of purely illustrative and non-limiting example, an embodiment with reference to the accompanying drawings in which.

Figure 1:
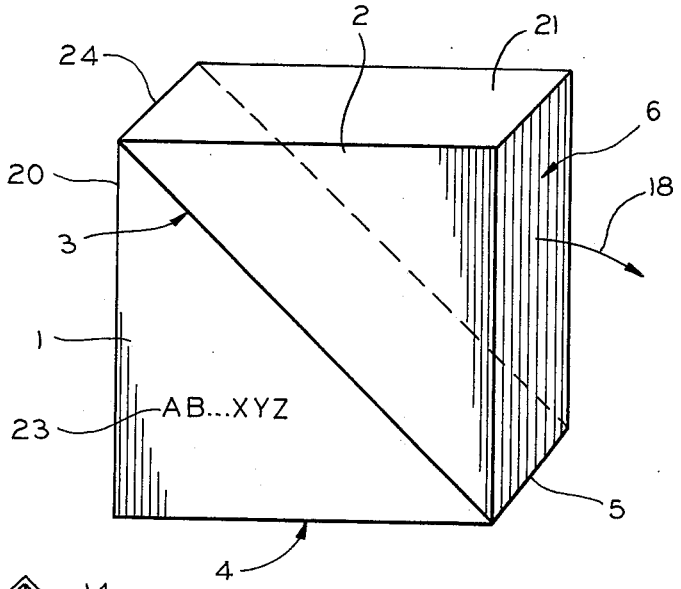
FIG. 1 represents a perspective view of an embodiment of the display case.

The display case shown in FIGS. 1, 2, 3 and 5 has an inside parallelepipedic shape and comprises two symmetrical parts 1 and 2 separated by diagonal plane 3 of the parallelepipedic volume.

One of the parts 1 called "immobile" comprises a lower plane face 4 constituting the base on which the display case rests.

The other part 2 is mobile relative to the first and is articulated on it around a horizontal axis 5 merged with one of the lower edges of the parallelepipedic volume, this axis 5 being located in diagonal plane 3.

Figure 2:
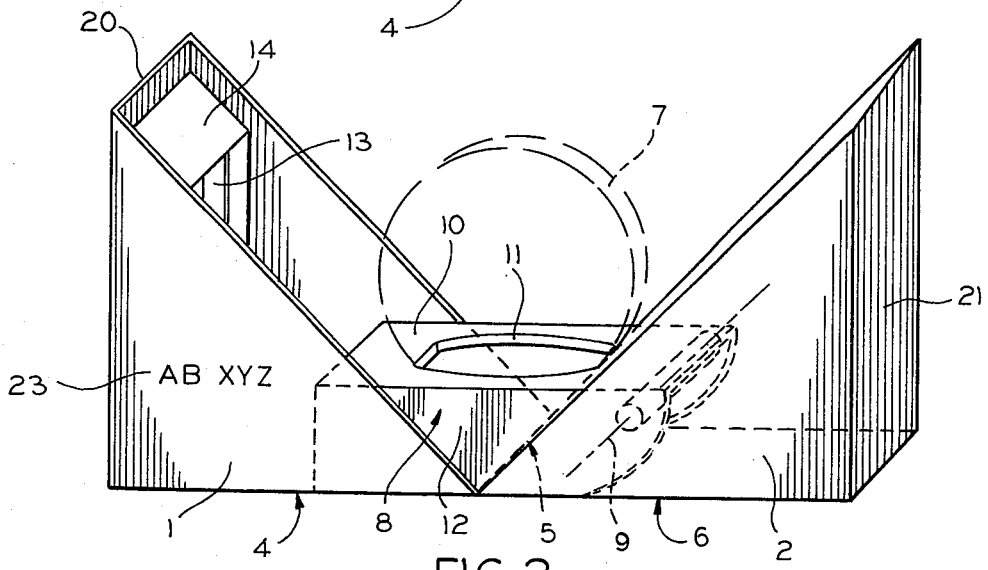
FIG. 2 represents the display case of FIG. 1 in its totally open position.

Mobile part 3 can pivot around axis 5 along arrow 18 of FIG. 1 to open the display case as shown in FIG. 2.

In this open position, face 6 of mobile part 2, which is adjacent to base 4 of immobile part 4, is located in the same plane as base 4 so that the two half boxes 1 and 2 together from a V-shaped space at right angle.

In the plane of symmetry of this V-shaped space appears the luxury article to be displayed, for example, a bottle 7 containing perfume which rests on a support 8 articulated on mobile part 2 articulated around a horizontal axis 9 parallel to axis 5.

Support 8 comprises a horizontal plane upper face 10 advantageously provided with a receiving housing 11 into which bottle 7 has been lightly forced to be wedged and imprisoned there.

Support 8 also comprises two vertical side flanges 12 intended to facilitate the sliding of support 8 in immobile part 1. For this purpose, the width of support 8, i.e., the distance separating the two parallel flanges 12, is equal to the distance separating the faces of the case located opposite flanges 12 so that sliding occurs with slight friction.

Bottle 7 is held in place by the closed display case thanks to two housings 13 and 17, respectively, made by cut-outs made in the cardboard wedging elements 14 and 19, respectively, fastened in each half box 1 and 2, respectively, under faces 20 and 21.

Figures 3, 5:
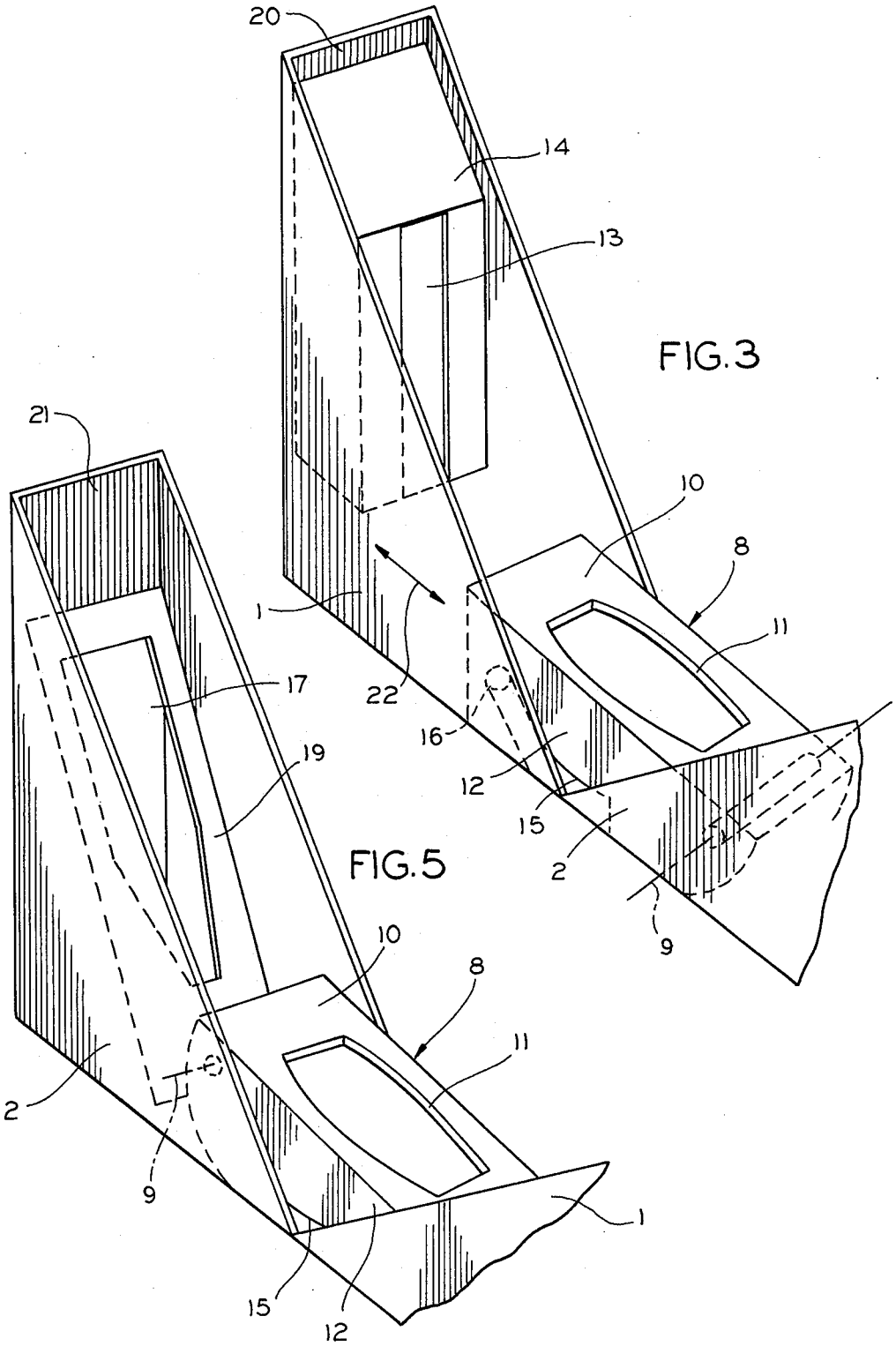
FIG. 3 represents a perspective view of the inside of the immobile part of the display case of FIG. 2.
FIG. 5 represents a perspective view of the inside of the mobile part of the display case of FIG. 2.

In the case closed position, support 8 for displaying the bottle is housed under wedging element 14 of part 1 as has been schematized by arrow 22 of FIG. 3.

Side housing 13 then receives bottle 7 and housing 17 receives the top of the bottle, generally made up of a cap so that the bottle is perfectly wedged inside the case.

Support 8 is guided so as to remain (approximately) horizontal during its translation when mobile part 2 is moved around axis 5 to open and spread out the display case.

Figure 4:
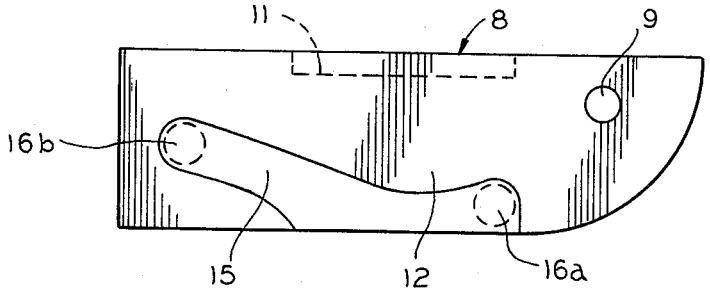
FIG. 4 represents an elevation view of the support of the article to be displayed.

FIG. 4 shows a means for keeping support 8 approximately horizontal during its translation.

In FIG. 4 the axis of articulation of support 8 on mobile part 2 has been shown by a circle 9. This circle represents a hole made in each vertical flange 12 of support 8 and intended to receive a pin (not shown) fastened interiorly on each of the two faces opposite mobile part 2. The two pins solid with part 2 consequently constitute axis 9 allowing a slight rotation of support 8 on mobile part 2.

Guiding of support 8 is assured, for example, by a guide slot 15 made in each side flange 12 of support 8, or as a variant in only one of these two flanges, preferably (for aesthetics) the flange called the "black flange" which is opposite the front face of the case on which are marked references 23 of the packaged article. Each slot 15 works with at least a pin (not shown) fastened on the inside wall of part 1 which faces said slot.

The shape of this slot 15 forming the cam track is made so as to force support 8 to remain fairly horizontal during its removal from part 1, to keep bottle 7, which is simply set in its housing 11, from turning over. Each slot 15 advantageously has the shape shown in FIG. 4, namely, a long descent inclined about 25° on the horizontal followed by a short rise similarly inclined on the horizontal, the juncture point of the descent and rise being located approximately plumb with axis 5 when the case is totally open as shown in FIG. 5.

In the closed position of the case, the pin forming the cam and working with slot 15 occupies the position shown as 16*a* in FIG. 4, while in the totally open position said pin occupies the position shown as 16*b*.

When the display case is closed, support 8 and its bottle 7 resume their initial place, the bottle remaining perfectly wedges in its various housings, both on its support 8 and in the two half boxes 1 and 2 that are closed.

Naturally, the invention is not limited to the application or the embodiment just described and many variants of the display case can be thought of without going outside the scope of this invention. Thus the shape of the two parts of the box can vary greatly, said two parts not necessarily being symmetrical.

Also there can be provided in the zone of edge 24 placed at the upper part of diametral plane 3 a ratchet and/or locking device for locking the two parts 1 and 2 constituting the case.

Also, mobile part 2 can move, relative to first immobile part 1, either by translation or in a complex movement. The approximately horizontal translation movement is, of course, the preferred movement; in this regard, axis 9 should remain at a fairly constant distance from the horizontal plane extending base 4 at the time of opening and closing the case since then, because the opposite end of support 8 rests on the bottom of base 4, said support necessarily makes a slight upward inclination, toward axis 9, outside the complete open position which corresponds to a perfectly horizontal arrangement for the upper flat face 10. In other words, for the inclination of upper face 10 to vary little in relation to the horizontal, axis 9 must be as close as possible to diagonal plane 3 to reduce as much as possible the vertical deflection of axis 9 in relation to the horizontal plane extending base 4.

Other means can be imagined to constraint the bottle support that is to be removed from its housing and to guide it during opening of the display case.

Finally, the invention applies not only to the display of perfume bottles but also to any other luxury article such as jewel, lighter, for example, able to be displayed and exposed.

I claim:

1. Display case, particularly for luxury articles, such as a perfume bottle, jewel, or lighter, which comprises: two parts integral with one another, the one called "immobile" comprising a plane base acting as a support for the case when closed and the other being mobile in relation to the first; a support used for displaying the article mounted on the inside of the case being articulated on said mobile part and able, during movement of this mobile part, to slide in the first part, approximately in horizontal translation, so as to remove said support from the first part of the case and expose it to view between the two parts of the case.

2. Display case according to claim 1 wherein it is parallelepipedic and opens along a diagonal plane, its mobile part being articulated on another part around a horizontal axis located at the lower end of the diagonal plane.

3. Display case according to claim 2 wherein the display support is articulated on mobile part around two pins defining an axis of rotation parallel to axis.

4. Display case according to claim 1 wherein the display support is provided with guide means working with complementary organs solid with first part of the display case to assure that said translation is approximately horizontal.

5. Display case according to claim 4 wherein said guide means are made up at least of a groove shaped laterally to the support and working with at least a pin fastened on the inside face of the first part of the case.

6. Display case according to claim 1 wherein the width of the display support is equal to the distance separating the opposite faces of the case so that the sliding is done with slight friction.

7. Display case according to claim 1 wherein the display support comprises a plane upper face in which is made a housing for receiving the article to be displayed.

8. Display case according to claim 1 wherein each of said parts is provided on the inside with an element for setting of the article to wedge this latter in the display case when it is completely closed.

9. Display case according to claim 1 wherein, in its open position, it delimits a V-shaped space and the article to be displayed is exposed approximately in the plane of symmetry of the V-shaped space thus deployed.

* * * * *